US011066965B1

(12) United States Patent
Heggie et al.

(10) Patent No.: US 11,066,965 B1
(45) Date of Patent: Jul. 20, 2021

(54) SYSTEMS AND METHODS FOR HYDRAULIC LASH ADJUSTER OIL FLOW

(71) Applicant: Ford Global Technologies, LLC, Dearborn, MI (US)

(72) Inventors: Forest Heggie, LaSalle (CA); Robert Stephen Furby, Novi, MI (US); Jeff D. Fluharty, Woodhaven, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/891,448

(22) Filed: Jun. 3, 2020

(51) Int. Cl.
*F01L 1/24* (2006.01)
*F01L 13/00* (2006.01)

(52) U.S. Cl.
CPC ..... *F01L 1/2405* (2013.01); *F01L 13/0005* (2013.01); *F01L 2001/2433* (2013.01); *F01L 2001/2444* (2013.01); *F01L 2013/001* (2013.01)

(58) Field of Classification Search
CPC ..... F01L 1/2405; F01L 2001/2444; F01L 13/0005; F01L 2013/001
USPC ..... 123/90.43, 90.46, 481, 198 F
See application file for complete search history.

(56) References Cited

U.S. PATENT DOCUMENTS

| | | | | |
|---|---|---|---|---|
| 9,157,340 | B2 | 10/2015 | Smith et al. | |
| 2016/0102585 | A1* | 4/2016 | Evans | F01L 13/0005 123/90.12 |
| 2016/0281551 | A1 | 9/2016 | Crowe | |
| 2016/0319706 | A1* | 11/2016 | McConville | F01L 1/2405 |
| 2017/0002703 | A1* | 1/2017 | Khadilkar | F01M 1/12 |
| 2017/0356355 | A1* | 12/2017 | Rollinger | F02D 41/26 |

* cited by examiner

*Primary Examiner* — Jorge L Leon, Jr.
(74) *Attorney, Agent, or Firm* — Geoffrey Brumbaugh; McCoy Russell LLP

(57) ABSTRACT

Methods and systems are provided for oil flow for hydraulic lash adjusters of a vehicle engine. In one example, an engine cylinder bank includes a plurality of deactivatable hydraulic lash adjusters and a plurality of non-deactivatable hydraulic lash adjusters. A first linear oil supply passage and a second linear oil supply passage are formed within the cylinder bank and extend linearly through the cylinder bank without bends or curvature to the deactivatable and non-deactivatable hydraulic lash adjusters, with the deactivatable and non-deactivatable hydraulic lash adjusters having a same length.

18 Claims, 8 Drawing Sheets

SYSTEMS AND METHODS FOR HYDRAULIC LASH ADJUSTER OIL FLOW

FIELD

The present description relates generally to methods and systems for oil flow for hydraulic lash adjusters of a vehicle engine.

BACKGROUND/SUMMARY

Vehicle engines often include hydraulic lash adjusters, with each hydraulic lash adjuster (HLA) configured to reduce a gap, or lash, between a corresponding rocker arm of the engine and a cam of a camshaft. Oil provided to each HLA via an oil passage of the engine may lubricate the components of each HLA, with a pressure of the oil engaging each HLA with the corresponding rocker arm. Further, some engines include one or more deactivatable cylinders, and the HLAs configured to engage with the rocker arms driving valves of the deactivatable cylinders may be referred to as deactivatable HLAs. Each deactivatable HLA may include components configured to isolate a motion of the coupled rocker arm from the corresponding driven valve of the deactivatable cylinder during conditions in which pressurized oil is provided at an inlet of the deactivatable HLA by a second oil passage of the engine. By selectively providing the pressurized oil at the inlet of each deactivatable HLA, the deactivatable cylinders may be adjusted between an activated condition in which valves of the deactivatable cylinders are opened and closed by the rocker arms, and a deactivated condition in which the valves of the deactivatable cylinders are maintained in the closed position and not adjusted by the rocker arms.

However, the inventors herein have recognized potential issues with such systems. As one example, configuring the oil passages to connect to the various different HLAs may be difficult and/or more costly due to a relative arrangement of other engine components, such as intake valves and exhaust valves. Additionally, because deactivatable HLAs include various other components relative to the non-deactivatable HLAs to enable the deactivation of cylinder valves, the components of the deactivatable HLAs and non-deactivatable HLAs may have a different relative arrangement which may increase the difficulty of connecting the HLAs to the oil passages due to the drilling and/or casting of the oil passages in complex configurations to align with the HLAs.

In one example, the issues described above may be addressed by A system, comprising: an engine including a cylinder bank having a plurality of deactivatable inner cylinders and a plurality of outer cylinders; a cylinder head capping the cylinder bank; a linear oil supply passage formed in the cylinder head and arranged parallel to a crankshaft of the engine; a plurality of deactivatable hydraulic lash adjusters (HLAs) arranged along a linear flow path of the linear oil supply passage and configured to receive engine oil directly from the linear oil supply passage to control deactivation of the plurality of deactivatable inner cylinders; and a plurality of non-deactivatable HLAs arranged along the linear flow path and configured to receive the engine oil directly from the linear oil supply passage. In this way, the linear oil supply passage may more easily connect to the HLAs, and a production time and/or cost of the engine may be reduced.

As one example, the linear oil supply passage may be drilled and/or otherwise machined into the cylinder head in a straight, linear direction. The length of each of the deactivatable HLAs may be the same as the length of each of the non-deactivatable HLAs such that the linear oil supply passage aligns with each of the HLAs. As a result, the linear oil supply passage may couple to multiple deactivatable and non-deactivatable HLAs without complicated bending and/or angling of the linear oil supply passage, and an ease of production of the system may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-9 are shown to scale, although other relative dimensions may be used, if desired.

DETAILED DESCRIPTION

Figure 4:
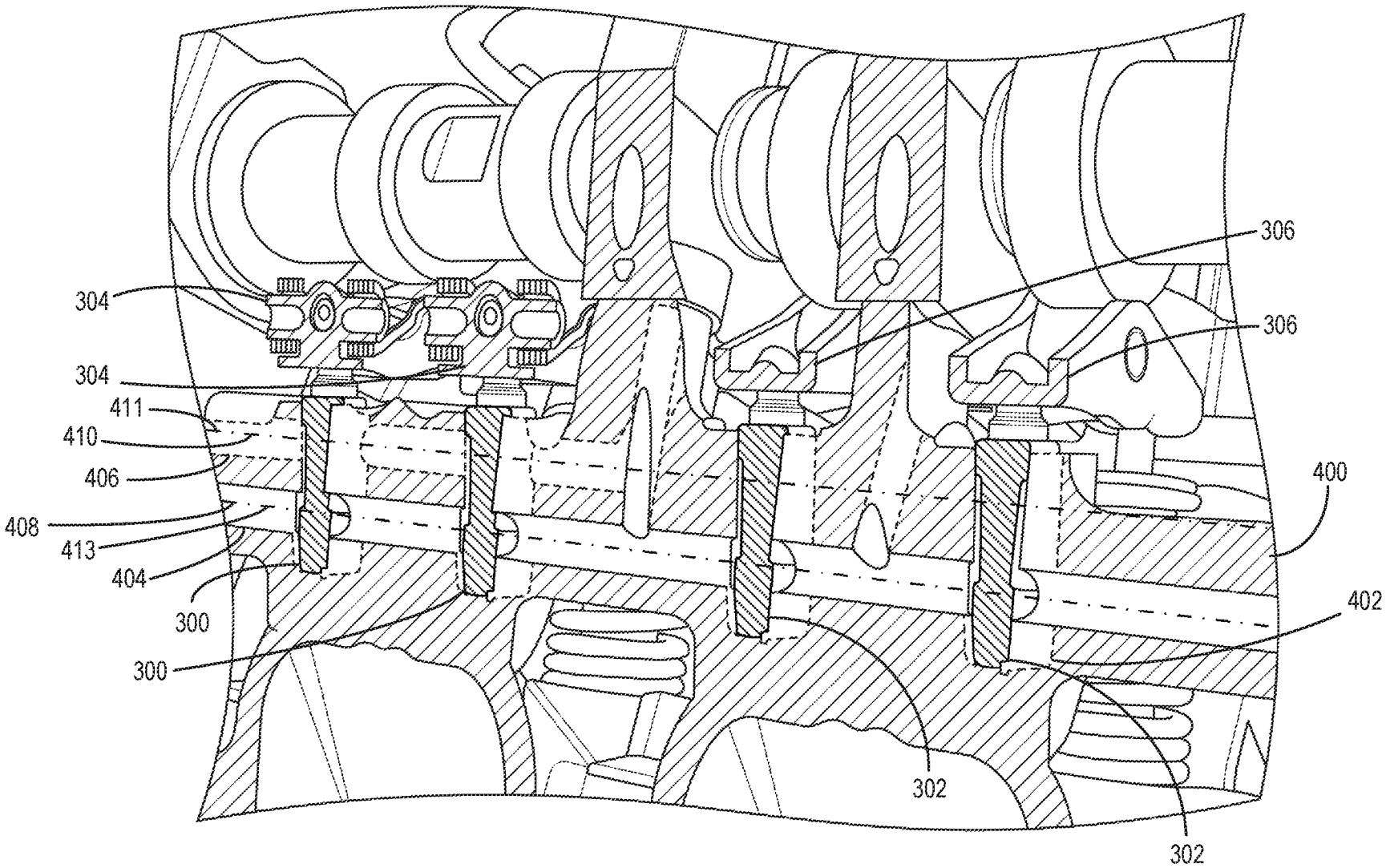
FIG. 4 shows a perspective view of the hydraulic lash adjusters of FIG. 3 seated in a cylinder head of the engine system and connected to linear oil passages of the cylinder head.
Figure 5:
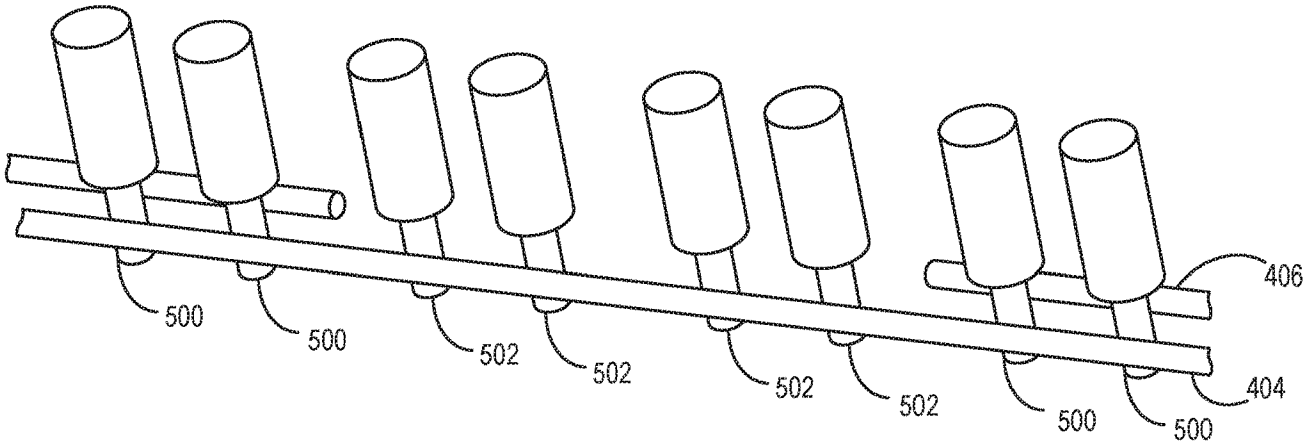
FIG. 5 shows a perspective view of linear oil passages and lash adjuster sockets of a first cylinder bank of the cylinder head of FIG. 4.
Figure 6:
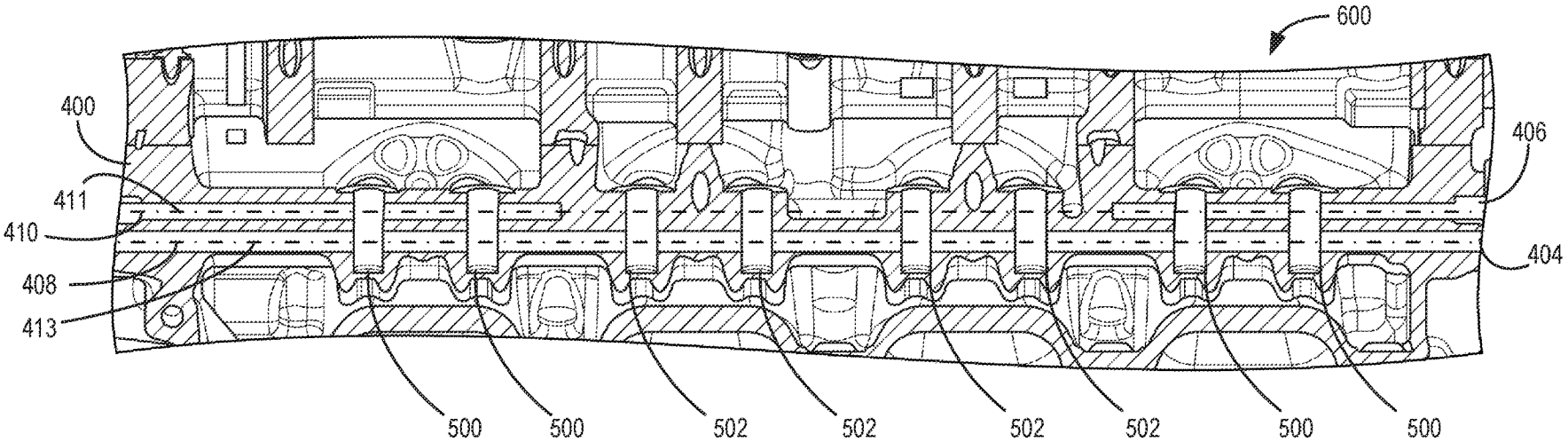
FIG. 6 shows another perspective view of the linear oil passages and lash adjuster sockets of FIG. 5.
Figure 7:
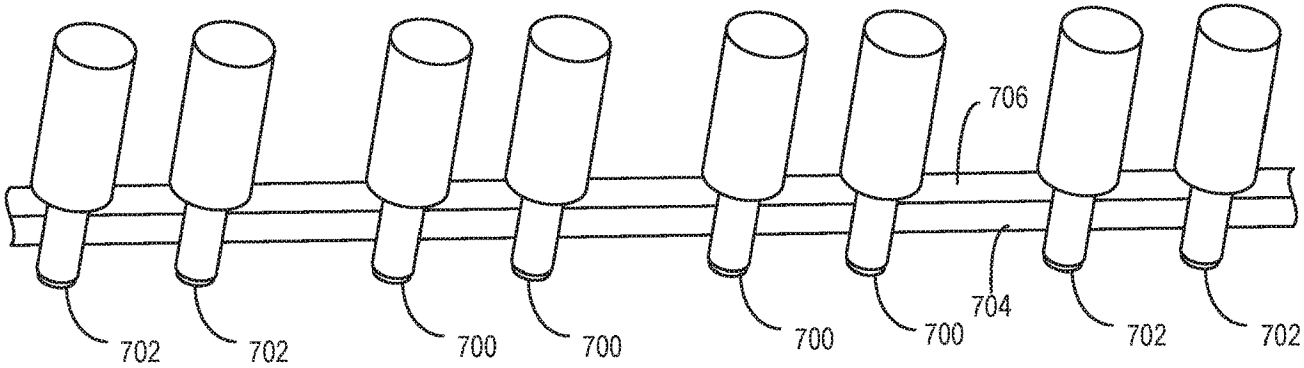
FIG. 7 shows a perspective view of linear oil passages and lash adjuster sockets of a second cylinder bank of the cylinder head of FIG. 4.
Figure 8:
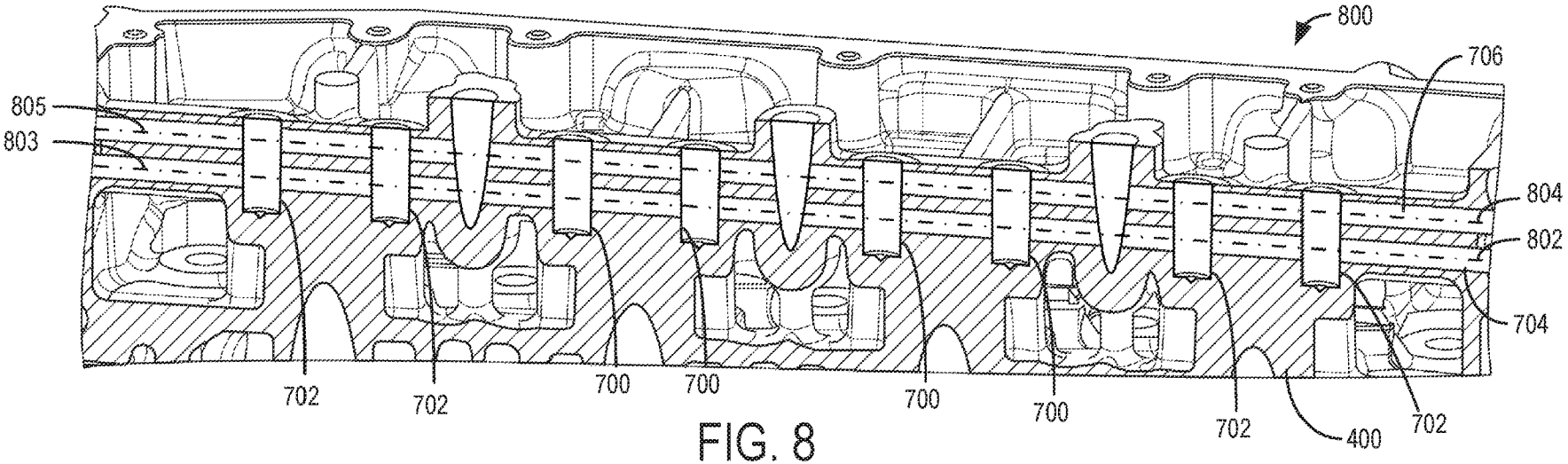
FIG. 8 shows another perspective view of the linear oil passages and lash adjuster sockets of FIG. 7.
Figure 9:
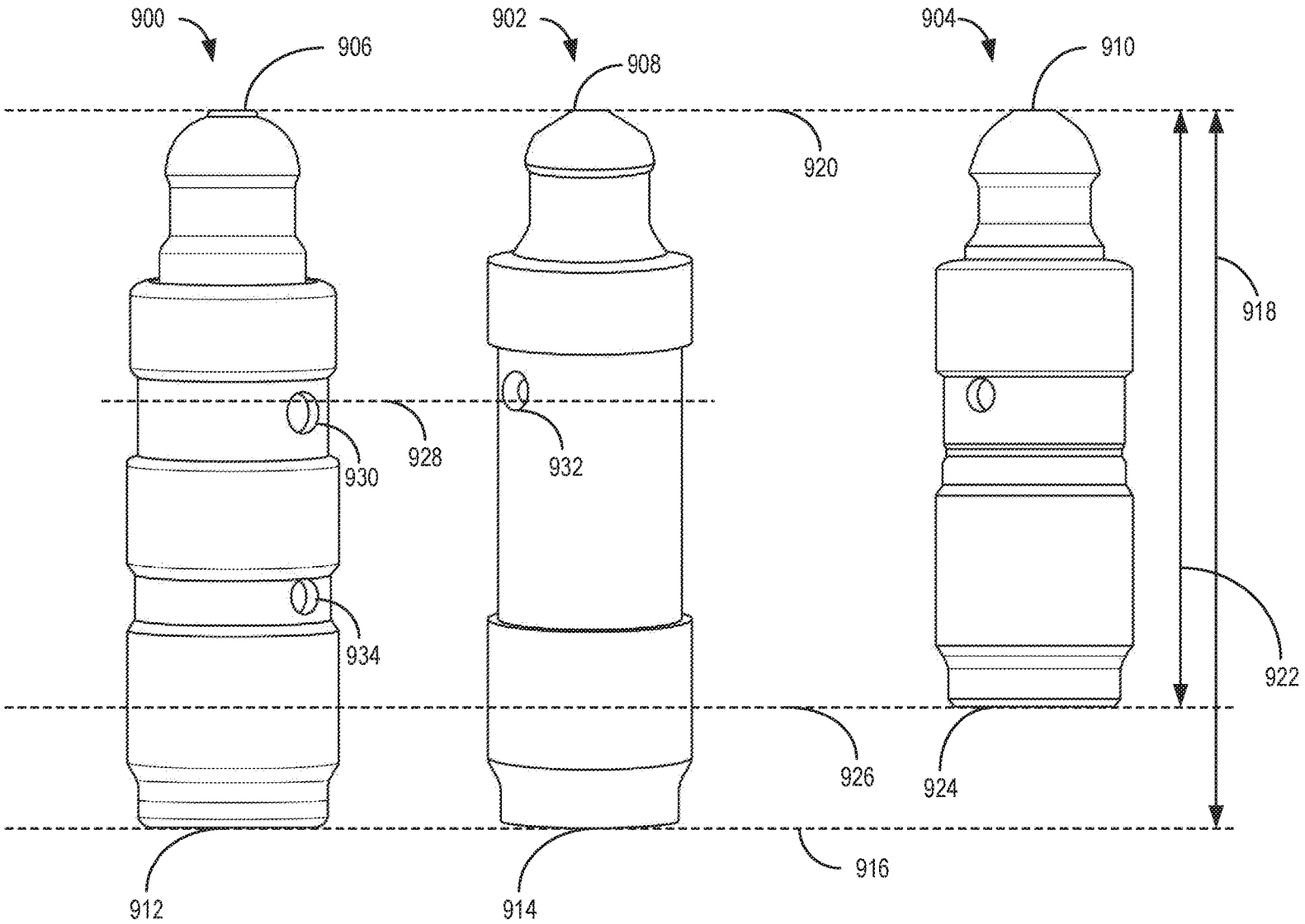
FIG. 9 shows the deactivatable and non-deactivatable hydraulic lash adjusters of FIGS. 3-4 adjacent to a conventional hydraulic lash adjuster.
Figure 10:
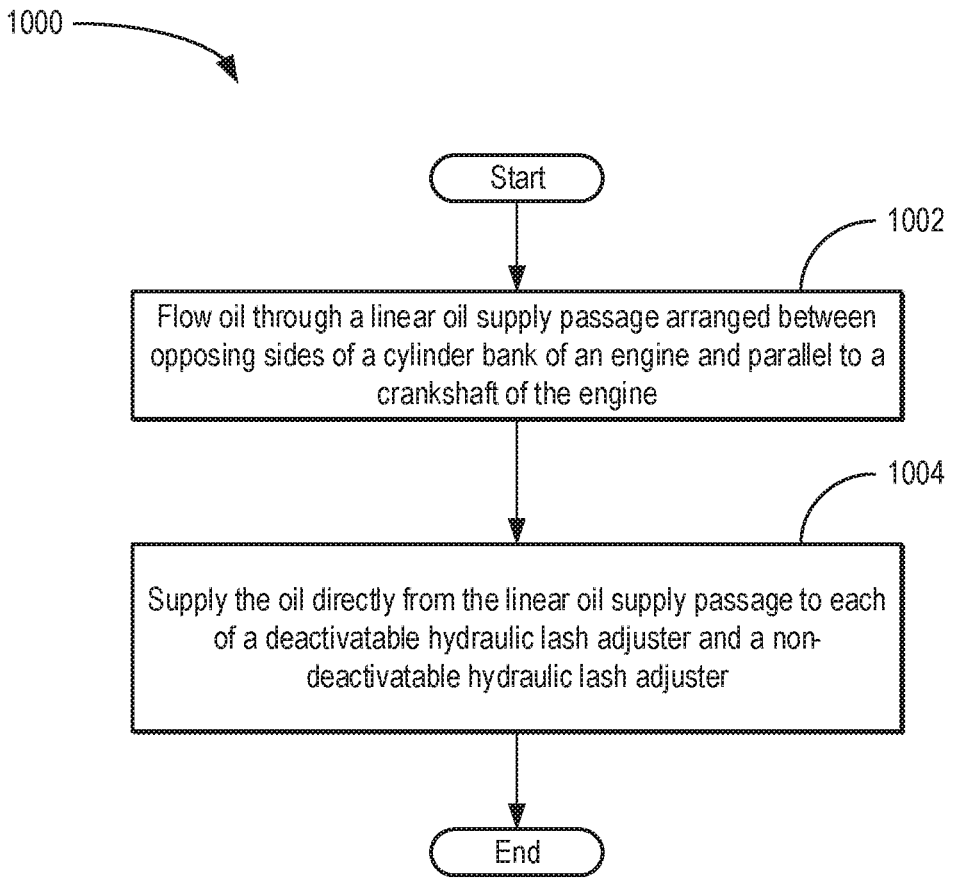
FIG. 10 shows a flowchart illustrating a method for supplying oil to hydraulic lash adjusters of an engine via a linear oil supply passage.

The following description relates to systems and methods for oil flow for hydraulic lash adjusters of a vehicle engine. An engine, such as the engine shown by FIG. 1, includes a plurality of hydraulic lash adjusters, such as the hydraulic lash adjusters shown by FIG. 2. Each hydraulic lash adjuster is coupled to a respective rocker arm, such as the rocker arms shown by FIG. 3. The hydraulic lash adjusters are seated within respective sockets formed within a cylinder head of the engine, as shown by FIG. 4, and the sockets are fluidly coupled to linear oil passages extending through the cylinder head, as shown by FIGS. 5-8. The engine may include a first group of the linear oil passages arranged at a first cylinder bank, as shown by FIGS. 5-6, and a second group of the linear oil passages arranged at an opposing, second cylinder bank, as shown by FIGS. 7-8. The plurality of hydraulic lash adjusters includes deactivatable and non-deactivatable hydraulic lash adjusters, with the non-deactivatable hydraulic lash adjusters being a same size as the deactivatable hydraulic lash adjusters, as shown by FIG. 9. By configuring the non-deactivatable hydraulic lash adjusters to be the same size as the deactivatable hydraulic lash adjusters, the deactivatable and non-deactivatable hydraulic lash adjusters seat within the sockets of the cylinder head in alignment with the linear oil passages. In this way, the linear oil passages may be formed without bends or curves through the cylinder head in order to deliver oil to the deactivatable and non-deactivatable hydraulic lash adjusters, as illustrated by the flowchart of FIG. 10. As a result, a production cost of the engine may be reduced and/or an ease of maintenance of the engine may be increased.

Figure 1:
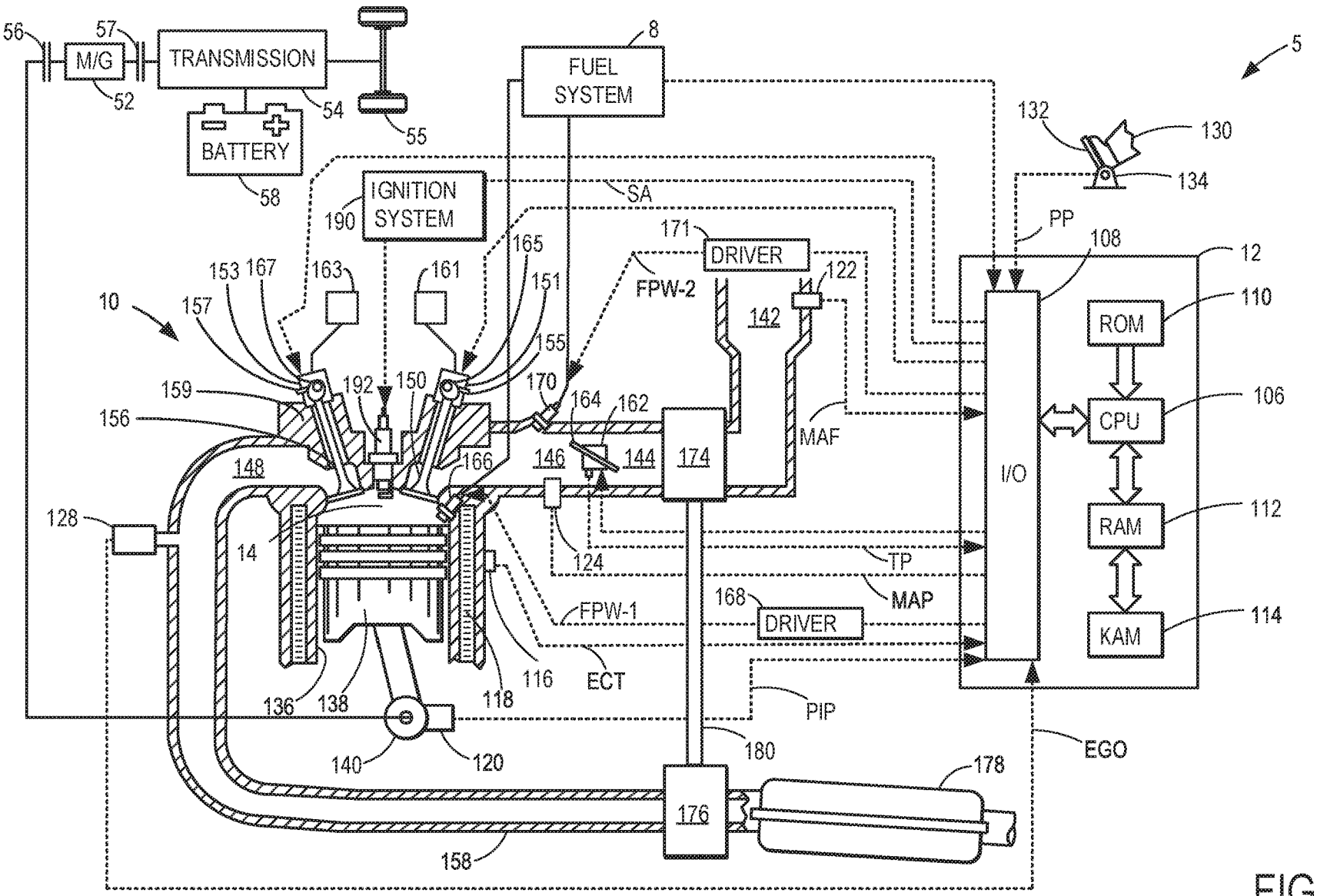
FIG. 1 shows a schematic diagram of an engine system including a plurality of intake valves and exhaust valves.

Referring now to FIG. 1, an example of a cylinder 14 (which may be referred to herein as a combustion chamber) of internal combustion engine 10 is shown included within vehicle 5. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 of engine 10 may include cylinder walls 136 capped by cylinder head 159. The cylinder head 159 includes a plurality of passages formed by interior surfaces of the cylinder head 159 and configured to flow hydraulic fluid (e.g., engine oil) to various components of the engine 10 (e.g., hydraulic lash adjusters as described further below). The cylinder 14 includes a piston 138 positioned therein. Piston 138 may be coupled to crankshaft 140 so that reciprocating motion of the piston is translated into rotational motion of the crankshaft. Crankshaft 140 may be coupled to at least one drive wheel of the vehicle 5 via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine 10. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 includes one or more intake valves and one or more exhaust valves. For example, cylinder 14 is shown including at least one intake poppet valve 150 and at least one exhaust poppet valve 156 located at an upper region of cylinder 14 (e.g., disposed within cylinder head 159). In some examples, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams (e.g., intake cam 165 and exhaust cam 167, respectively) and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, one of the intake or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a shared valve actuator or actuation system, with the shared valve actuator configured to actuate both of the intake valve and exhaust valve.

The intake valve and exhaust valve may each be coupled to a respective valve drive assembly configured to control a motion (e.g., opening and closing) of the intake valve and exhaust valve. In particular, intake valve 150 is shown coupled to valve drive assembly 161, and exhaust valve 156 is shown coupled to valve drive assembly 163. Each of the valve drive assemblies includes a respective hydraulic lash adjuster (HLA) and a respective rocker arm, with the rocker arm arranged between the HLA and the corresponding driven valve (e.g., intake valve or exhaust valve). The HLA is configured to reduce a lash, or gap, between the rocker arms and the cams of the camshaft. For example, valve drive assembly 161 includes an intake HLA configured to reduce a lash between a rocker arm of valve drive assembly 161 and intake cam 165, and valve drive assembly 163 includes an exhaust HLA configured to reduce a lash between a rocker arm of valve drive assembly 163 and exhaust cam 167.

In some examples, the cylinder 14 may be a deactivatable cylinder, with the HLAs of the valve drive assembly 161 and the valve drive assembly 163 being deactivatable HLAs. For example, the valve drive assembly 161 may include a deactivatable HLA configured to selectively disable the opening and closing of the intake valve 150 responsive to a flow of pressurized oil provided at an inlet (which may be referred to herein as a deactivation inlet) of the deactivatable HLA via an oil passage within cylinder head 159. By disabling the opening and closing of the intake valve 150 via the deactivatable HLA, combustion of fuel and air within the cylinder 14 may be disabled (e.g., in order to temporarily reduce a torque output and/or fuel consumption of the engine). The flow of pressurized oil to the inlet of the deactivatable HLA may be controlled by controller 12 via one or more oil flow valves (e.g., solenoid valves), with the oil flow valves controlling the flow of oil within the oil passage connected to the inlet of the deactivatable HLA.

The controller may transmit electrical signals to the oil flow valves order to adjust the oil flow valves to a fully closed position, a fully opened position, or a plurality of positions between the fully closed position and the fully opened position. In one example, the intake valve 150 may be driven by the valve drive assembly 161 (e.g., opened and closed by a pivoting of the rocker arm of the valve drive assembly 161) during conditions in which pressurized oil is provided to the inlet of the deactivatable HLA of the valve drive assembly 161 by adjusting the oil flow valves to the fully opened position. The opening and closing of the intake valve 150 may be disabled during conditions in which pressurized oil is not provided to the inlet of the deactivatable HLA of the valve drive assembly 161 (e.g., by adjusting the oil flow valves to the fully closed position). Although operation of the intake valve 150 is described herein as an example, the exhaust valve 156 may operate in a similar way (e.g., with the operation of the exhaust valve 156 being adjusted via the valve drive assembly 163).

Although valve drive assembly 161 and intake valve 150 are described above as an example, the valve drive assembly 163 and exhaust valve 156 may include a similar configuration (e.g., valve drive assembly 163 may include a deactivatable HLA configured to disable an opening and closing of exhaust valve 156). In other examples, the cylinder 14 may be a non-deactivatable cylinder, with the HLAs of the valve drive assembly 161 and valve drive assembly 163 being non-deactivatable HLAs that are not configured to disable the opening and closing of the respective driven valves. Further, engine 10 is configured to include deactivatable cylinders and non-deactivatable cylinders. Similar to the examples described below (e.g., with reference to FIGS. 2-8), engine 10 may be configured as a V8 engine including two cylinder banks, with each cylinder bank including four cylinders (e.g., similar to cylinder 14) and with one or more of the cylinders being configured as a deactivatable cylinder, similar to the example described above.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and/or fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle (e.g., combustion cycle) of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

The controller 12 receives signals from the various sensors of FIG. 1 and employs the various actuators of FIG. 1 to adjust engine operation based on the received signals and instructions stored on a memory of the controller. For example, in configurations in which cylinder 14 is a deactivatable cylinder, adjusting the intake valve 150 from an activated condition in which the intake valve 150 is opened and closed by valve drive assembly 161 to a deactivated condition in which the intake valve 150 is not opened and closed by valve drive assembly 161 may include increasing a flow of pressurized oil to the inlet (e.g., deactivation inlet) of the deactivatable HLA of the valve drive assembly 161. For example (as described above), the controller 12 may transmit electrical signals to one or more oil control valves configured to control the flow of pressurized oil to the inlet of the deactivatable HLA via the oil passage of the cylinder head 159 in order to move the oil control valves to an opened position to provide the pressurized oil at the inlet of the deactivatable HLA.

As described above, FIG. 1 shows only one cylinder of a multi-cylinder engine. As such, each cylinder may similarly include its own set of intake/exhaust valves, hydraulic lash adjusters, rocker arms, fuel injector(s), spark plug, etc. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 57 is provided between electric machine 52 and transmission 54. Controller 12 may send a signal to an actuator of each clutch (e.g., first clutch 56 and/or second clutch 57) to engage or disengage the clutches, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Figure 2:
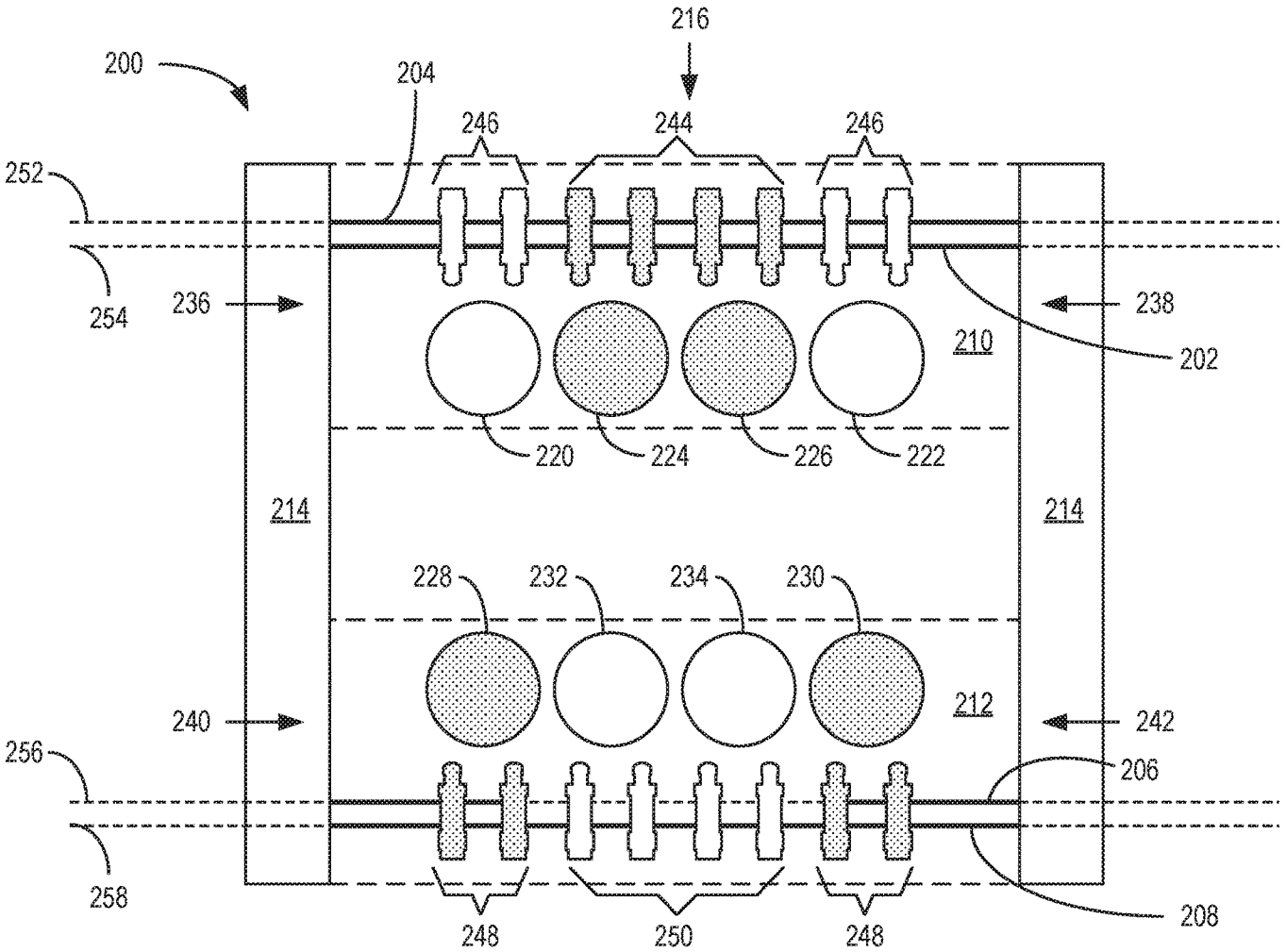
FIG. 2 shows a schematic diagram of an engine system including two cylinder banks, with each cylinder bank including linear oil passages connected to hydraulic lash adjusters.

Referring to FIG. 2, an engine 200 is shown. The engine 200 may be similar to, or the same as, the engine 10 shown by FIG. 1 and described above. Further, engine 200 includes several components that may be similar to, or the same as, the components described above with reference to FIG. 1. For example, engine 200 includes cylinders which may be similar to, or the same as, cylinder 14 described above.

The engine 200 is configured as a V8 engine including two cylinder banks, with each cylinder bank arranged at an opposing side of the engine 200. In particular, engine 200 includes a first cylinder bank 210 arranged at a first side 216 of the engine 200, and a second cylinder bank 212 arranged at an opposing, second side 218 of the engine 200. The first cylinder bank 210 includes four cylinders arranged in an inline configuration, and the second cylinder bank 212 is arranged parallel with the first cylinder bank 210 and includes four cylinders arranged in an inline configuration. In particular, the first cylinder bank 210 includes first outer cylinder 220, second outer cylinder 222, first inner cylinder 224, and second inner cylinder 226, and the second cylinder bank 212 includes third outer cylinder 228, fourth outer cylinder 230, third inner cylinder 232, and fourth inner cylinder 234. The first outer cylinder 220 is arranged at a first side 236 of the first cylinder bank 210 and the second outer cylinder 222 is arranged at an opposing, second side 238 of the first cylinder bank 210. The third outer cylinder 228 is arranged at a first side 240 of the second cylinder bank 212 and the fourth outer cylinder 230 is arranged at an opposing, second side 242 of the second cylinder bank 212. One or more of the cylinders of the first cylinder bank 210 may be configured to be deactivatable (e.g., similar to the example described above with reference to FIG. 1), and one or more of the cylinders of the second cylinder bank 212 may be configured to be deactivatable. In the example shown, the shading pattern indicates the cylinders that are deactivatable, while the cylinders that are shown without shading are non-deactivatable.

The engine 200 further includes a plurality of hydraulic lash adjusters (HLAs) arranged at each cylinder bank. In particular, the first cylinder bank 210 includes deactivatable HLAs 244 (indicated with the shading pattern) and non-deactivatable HLAs 246, and the second cylinder bank 212 includes deactivatable HLAs 248 and non-deactivatable HLAs 250. The deactivatable HLAs 244 of the first cylinder bank 210 may control deactivation of the first inner cylinder 224 and second inner cylinder 226, and the deactivatable HLAs 248 of the second cylinder bank 212 may control deactivation of the third outer cylinder 228 and fourth outer cylinder 230.

Each of the deactivatable HLAs 244 and non-deactivatable HLAs 246 of the first cylinder bank 210 are fed (e.g., provided oil) by a first oil supply passage 202 and a second oil supply passage 204. The first oil supply passage 202 and second oil supply passage 204 each extend through the first cylinder bank 210 without bends or curvature from first side 236 of the first cylinder bank 210 to opposing, second side 238 of the first cylinder bank 210. In some examples, the first oil supply passage 202 and second oil supply passage 204 may have a same length (e.g., a length from the first side 236 of the first cylinder bank 210 to the second side 238 of the first cylinder bank 210). First oil supply passage 202 is shown extending along axis 254 and is parallel with axis 254, and second oil supply passage 204 is shown extending along axis 252 and is parallel with axis 252. In some examples, the first oil supply passage 202 and second oil supply passage 204 may be arranged parallel to each other.

The first oil supply passage 202 and second oil supply passage 204 each couple to the deactivatable HLAs 244 and non-deactivatable HLAs 246 of the first cylinder bank 210. In particular, the first oil supply passage 202 and second oil supply passage 204 each fluidly couple to respective oil inlets (e.g., lash adjustment inlet and deactivation inlet) of the deactivatable HLAs 244 without any intervening oil passages, and the first oil supply passage 202 fluidly couples to a respective oil inlet of each non-deactivatable HLA 246 without any intervening oil passages. In some examples, the first oil supply passage 202 and/or the second oil supply passage 204 may include restrictors, plugs, etc. configured to control the flow of oil to the deactivatable HLAs 244 and/or non-deactivatable HLAs 246. For example, although the first oil supply passage 202 is shown connected to each deactivatable HLA 244 and each non-deactivatable HLA 246, the first oil supply passage 202 may include one or more plugs disposed therein to control (e.g., restrict, direct, etc.) the flow of oil through the first oil supply passage 202.

The first oil supply passage 202 and second oil supply passage 204 may each supply oil to the corresponding HLAs, with no intervening passages disposed between the first oil supply passage 202 and the corresponding HLAs, and with no intervening passages disposed between the second oil supply passage 204 and the corresponding HLAs. Further, no other oil consumers are arranged along an entirety of first oil supply passage 202 and second oil supply passage 204 from the first side 236 of the first cylinder bank 210 to the second side 238 of the first cylinder bank 210. In particular, the first oil supply passage 202 and second oil supply passage 204 are oil passages dedicated to providing engine oil to the deactivatable HLAs 244 and non-deactivatable HLAs 246 and are maintained separate from (e.g., spaced apart from) a main oil gallery of the engine 200 (e.g., only the first oil supply passage 202 and second oil supply passage 204 flow oil to the corresponding HLAs at the first cylinder bank 210). The main oil gallery does not directly couple to any of the deactivatable HLAs 244 or the non-deactivatable HLAs 246. The first oil supply passage 202 and second oil supply passage 204 are shown extending linearly through (e.g., straight through) the first cylinder bank 210 and may receive oil via an engine block 214 of the engine 200. In some examples, the first oil supply passage 202 and second oil supply passage 204 may each be formed within the first cylinder bank 210 by drilling and/or other machining. Because the first oil supply passage 202 and second oil supply passage 204 extend through the first cylinder bank 210 without bends or curvature, a cost and/or complexity of the drilling and/or other machining may be reduced.

The third oil supply passage 206 and fourth oil supply passage 208 each fluidly couple directly to the deactivatable HLAs 248 of the second cylinder bank 212 (e.g., couple in fluid communication with the deactivatable HLAs 248, with no intervening passages separating the deactivatable HLAs 248 from the third oil supply passage 206 and fourth oil supply passage 208). In particular, the third oil supply passage 206 and fourth oil supply passage 208 each fluidly couple to respective oil inlets (e.g., lash adjustment inlet and deactivation inlet) of the deactivatable HLAs 248 without any intervening oil passages. However, the third oil supply passage 206 does not fluidly couple to the non-deactivatable HLAs 250 of the second cylinder bank 212. The fourth oil supply passage 208 fluidly couples directly to a respective oil inlet of each non-deactivatable HLA 250 without any intervening oil passages. Although the fourth oil supply passage 208 extends linearly through (e.g., straight through) an entire length of the second cylinder bank 212, the third oil supply passage 206 extends only partially through the second cylinder bank 212 and terminates within an interior of the second cylinder bank 212. Each of the fourth oil supply passage 208 and third oil supply passage 206 are connected to the opposing sides of the second cylinder bank 212 (e.g., first side 240 and second side 242). In some examples, the fourth oil supply passage 208 may have a same length as the length of the first oil supply passage 202 and second oil supply passage 204 described above. In this configuration, the third oil supply passage 206 does not feed the non-deactivatable HLAs 250 associated with the third inner cylinder 232 and fourth inner cylinder 234.

Although the fourth oil supply passage 208 is shown connected to each deactivatable HLA 248 and each non-deactivatable HLA 250, the fourth oil supply passage 208 may include one or more plugs disposed therein to control (e.g., restrict, direct, etc.) the flow of oil through the fourth oil supply passage 208 to one or more of the deactivatable HLAs 248 or non-deactivatable HLAs 250.

The third oil supply passage 206 and fourth oil supply passage 208 may each supply oil directly to the corresponding HLAs, with no intervening passages disposed between the third oil supply passage 206 and the corresponding HLAs, and with no intervening passages disposed between the fourth oil supply passage 208 and the corresponding HLAs. Further, no other oil consumers are arranged along an entirety of third oil supply passage 206 and fourth oil supply passage 208 from the first side 240 of the second cylinder bank 212 to the second side 242 of the second cylinder bank 212. In particular, the third oil supply passage 206 and fourth oil supply passage 208 are oil passages dedicated to providing engine oil to the deactivatable HLAs 248 and non-deactivatable HLAs 250 and are maintained separate from (e.g., spaced apart from) the main oil gallery of the engine 200 (e.g., only the third oil supply passage 206 and fourth oil supply passage 208 flow oil to the corresponding HLAs at the second cylinder bank 212). The main oil gallery does not directly couple to any of the deactivatable HLAs 248 or the non-deactivatable HLAs 250. In some examples, the third oil supply passage 206 and fourth oil supply passage 208 may each be formed within the second cylinder bank 212 by drilling and/or other machining. Because the third oil supply passage 206 and fourth oil supply passage 208 extend through the second cylinder bank 212 without bends or curvature, a cost and/or complexity of the drilling and/or other machining may be reduced.

Additionally, similar to the examples described further below, each of the deactivatable HLAs 244 and non-deactivatable HLAs 246 of the first cylinder bank 210 are the same length, and each of the deactivatable HLAs 248 and non-deactivatable HLAs 250 of the second cylinder bank 212 are the same length. By configuring the HLAs to have the same length, the various oil supply passages described above may be drilled and/or machined into the cylinder banks without bends, curves, or other angled portions, and a complexity of forming the oil supply passages to provide the various HLAs with oil may be reduced. As a result, a cost of the engine may be decreased.

Although the first cylinder bank 210 is shown including only a first set of deactivatable HLAs 244 and non-deactivatable HLAs 246, it should be appreciated that the first cylinder bank 210 may additionally include a second set of deactivatable HLAs 244 and non-deactivatable HLAs 246. In particular, the first set of deactivatable HLAs 244 and non-deactivatable HLAs 246 may be configured to control operation of a first set of valves (e.g., intake valves) of the cylinders of the first cylinder bank 210, and the second set of HLAs (not shown) may be configured to control operation of a second set of valves (e.g., exhaust valves) of the cylinders of the first cylinder bank 210. Similarly, although a single set of deactivatable HLAs 248 and non-deactivatable HLAs 250 is shown at the second cylinder bank 212, the HLAs shown may be configured to control operation of a first set of valves (e.g., exhaust valves) of the second cylinder bank 212. As such, the second cylinder bank 212 may include a second set of deactivatable HLAs and non-deactivatable HLAs to control operation of a second set of valves (e.g., intake valves) of the second cylinder bank 212.

Figure 3:
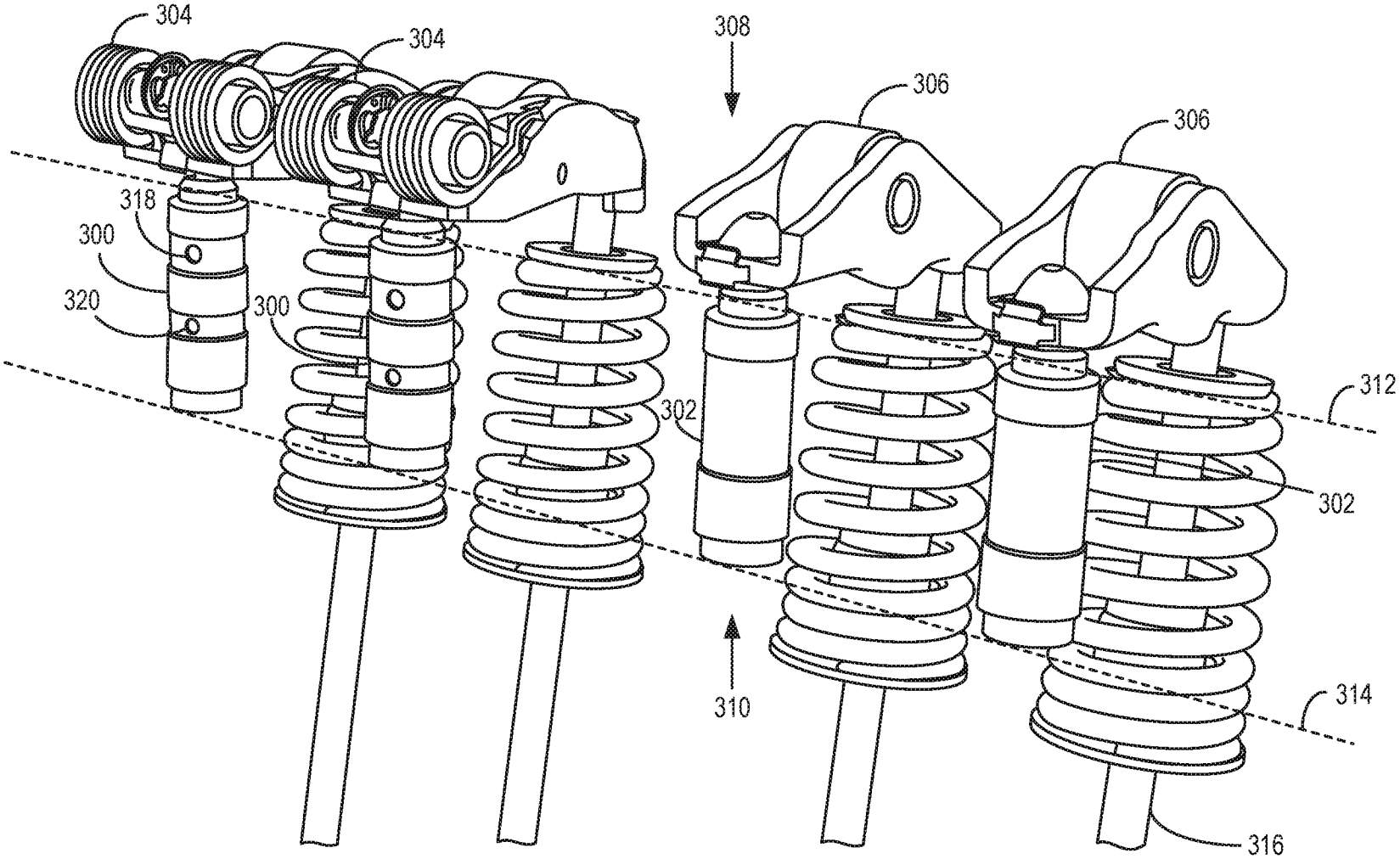
FIG. 3 shows a perspective view of deactivatable and non-deactivatable hydraulic lash adjusters coupled to rocker arms of an engine system.

Referring to FIG. 3, a perspective view of a plurality of HLAs is shown, with the HLAs coupled to respective rocker arms configured to drive valves of an engine. The components shown by FIG. 3 may be similar to, or the same as, the components described above with reference to FIGS. 1-2. For example, FIG. 3 shows deactivatable HLAs 300 which may be similar to, or the same as, deactivatable HLAs 248 shown by FIG. 2 and described above. FIG. 3 additionally shows non-deactivatable HLAs 302 which may be similar to, or the same as, non-deactivatable HLAs 250 shown by FIG. 2 and described above. Further, the components shown by FIG. 3 may be included in an engine similar to, or the same as, the engine 10 shown by FIG. 1 and/or the engine 200 shown by FIG. 2.

The deactivatable HLAs 300 are shown coupled to deactivatable rocker arms 304, and the non-deactivatable HLAs 302 are shown coupled to non-deactivatable rocker arms 306. The deactivatable rocker arms 304 are configured to drive valves (e.g., intake valves or exhaust valves) of a deactivatable cylinder (e.g., third outer cylinder 228 or fourth outer cylinder 230 shown by FIG. 2 and described above), and the non-deactivatable rocker arms 306 are configured to drive valves of a non-deactivatable cylinder (e.g., third inner cylinder 232 or fourth inner cylinder 234 shown by FIG. 2 and described above).

Similar to the examples described below, each of the deactivatable HLAs 300 and non-deactivatable HLAs 302 are configured to have a same length. Further, each of the deactivatable HLAs 300 and non-deactivatable HLAs 302 are aligned with each other along a same axis, such as axis 314 arranged along a bottom end 310 of each HLA and axis 312 arranged along the top end 308 of each HLA, with the top end 308 opposite to the bottom end 310. Each rocker arm is shown coupled to a respective valve stem (e.g., valve stem 316).

Each of the HLAs described above may include one or more inlets (e.g., lash adjustment inlets and/or deactivation inlets) configured to receive oil from oil supply passages of a cylinder head, as described below with reference to FIG. 4. For example, the deactivatable HLAs 300 are shown including a first inlet 318 (which may be referred to herein as a deactivation inlet) configured to receive oil from a first oil supply passage (e.g., for activation and deactivation of the deactivatable HLAs 300), and a second inlet 320 (which may be referred to herein as a lash adjustment inlet) configured to receive oil from a second oil supply passage (e.g., to provide pressure against a piston disposed within the deactivatable HLAs to press the deactivatable HLAs into engagement with the corresponding rocker arms and reduce a lash between the rocker arms and the valves driven by the rocker arms). The non-deactivatable HLAs 302 may each include a single inlet configured to receive oil from the second oil supply passage (e.g., for lash reduction, as described above).

Referring to FIG. 4, the HLAs described above with reference to FIG. 3 are shown seated within a cylinder head 400 of an engine (e.g., similar to cylinder head 159 described above with reference to FIG. 1). Each HLA is seated within a respective socket formed within an interior of the cylinder head 400, such as socket 402 indicated by dashed lines.

The cylinder head 400 includes a first oil supply passage 404 and a second oil supply passage 406. The first oil supply passage 404 and second oil supply passage 406 each extend through the cylinder head 400 in a linear direction (e.g., straight direction), without bends or curves, and fluidly couple directly to the deactivatable HLAs 300. The first oil supply passage 404 additionally extends linearly through (e.g., straight through) the cylinder head 400 and fluidly couples directly to the non-deactivatable HLAs 302 (e.g., couples in fluid communication with the deactivatable HLAs 302, with no intervening passages separating the deactivatable HLAs 302 from the first oil supply passage 404), whereas the second oil supply passage 406 terminates within the interior of the cylinder head 400 and does not fluidly couple to the non-deactivatable HLAs 302. The first oil supply passage 404 and second oil supply passage 406 may extend parallel to each other, as indicated by central axis 408 of first oil supply passage 404 extending parallel with central axis 410 of second oil supply passage 406. Oil within the first oil supply passage 404 may flow linearly through the first oil supply passage 404 in the direction of central axis 408 (e.g., along a linear flow path 413 parallel to central axis 408 or coaxial with central axis 408), and oil within the second oil supply passage 406 may flow linearly through the second oil supply passage 406 in the direction of central axis 410 (e.g., along a linear flow path 411 parallel to central axis 410 or coaxial with central axis 410). Each of the deactivatable HLAs 300 and non-deactivatable HLAs 302 are intersected by each of the central axis 408 and central axis 410. As a result, each deactivatable HLA 300 is arranged along the linear flow path 413 of oil flowing through the first oil supply passage 404 and the linear flow path 411 of oil flowing through the second oil supply passage 406.

Referring to FIGS. 5-6, different views of sockets formed in the cylinder head 400 are shown. In particular, FIG. 5 shows a view of the sockets and oil passages as solid forms without showing other components of the cylinder head 400, and FIG. 6 shows the sockets and oil passages arranged within the interior of the cylinder head 400 (e.g., forming cavities or hollow portions within the cylinder head 400). The sockets shown may be similar to the socket 402 shown by FIG. 4 and described above.

Each socket is configured to house a deactivatable or non-deactivatable HLA. In particular, sockets 500 are adapted to receive deactivatable HLAs, and sockets 502 are adapted to receive non-deactivatable HLAs. As described above, the deactivatable HLAs and non-deactivatable HLAs are configured to have the same length. As a result, the sockets 500 and sockets 502 each have the same length. However, sockets 500 are fluidly coupled to both of first oil supply passage 404 and second oil supply passage 406, while sockets 502 are fluidly coupled to first oil supply passage 404 and are not fluidly coupled to second oil supply passage 406. Each of the sockets 500 may house a respective deactivatable HLA such as the deactivatable HLAs 300 shown by FIG. 3 and described above, and each of the sockets 502 may house a respective non-deactivatable HLA such as the non-deactivatable HLAs 302 shown by FIG. 3 and described above. In the configuration shown by FIG. 6, the sockets 500 and sockets 502 are formed within the interior of cylinder head 400, with FIG. 6 showing a first cylinder bank 600 capped by the cylinder head 400. In one example, the first cylinder bank 600 may be similar to, or the same as, the second cylinder bank 212 shown by FIG. 2 and described above. In particular, the first cylinder bank 600 includes the sockets 500 of the deactivatable HLAs arranged at opposing sides of the first cylinder bank 600 (e.g., corresponding to the outer cylinders of the first cylinder bank 600 being deactivatable cylinders, similar to third outer cylinder 228 and fourth outer cylinder 230 described above), and the first cylinder bank 600 includes the sockets 502 of the non-deactivatable HLAs arranged at the central location of the first cylinder bank 600 (e.g., corresponding to the location of the non-deactivatable inner cylinders of the first cylinder bank 600, similar to third inner cylinder 232 and fourth inner cylinder 234 described above).

Referring to FIGS. 7-8, different views of additional sockets formed in a different cylinder bank capped by the cylinder head 400 are shown. In particular, FIG. 7 shows a view of the sockets and oil passages as solid forms without showing other components of the cylinder head 400, and FIG. 8 shows the sockets and oil passages arranged within the interior of the cylinder head 400 (e.g., forming cavities or hollow portions within the cylinder head 400). The sockets shown may be similar to the socket 402 shown by FIG. 4 and described above.

Each socket is configured to house a deactivatable or non-deactivatable HLA. In particular, sockets 700 are adapted to receive deactivatable HLAs, and sockets 702 are adapted to receive non-deactivatable HLAs. As described above, the deactivatable HLAs and non-deactivatable HLAs are configured to have the same length. As a result, the sockets 700 and sockets 702 each have the same length. Further, the sockets 700 and sockets 702 may have the same length as the sockets 500 and sockets 502 described above. However, the sockets 700 and sockets 702 are each fluidly coupled to both of first oil supply passage 704 and second oil supply passage 706. In one example, the first oil supply passage 704 may be similar to, or the same as, the second oil supply passage 204 described above with reference to FIG. 2 (with FIG. 8 indicating a central axis 802 of the first oil supply passage 704), and the second oil supply passage 706 may be similar to, or the same as, the first oil supply passage 202 described above with reference to FIG. 2 (with FIG. 8 indicating a central axis 804 of the second oil supply passage 706). Oil within the first oil supply passage 704 may flow linearly through the first oil supply passage 704 in the direction of central axis 802 (e.g., along a linear flow path 803 parallel to central axis 802 or coaxial with central axis 802), and oil within the second oil supply passage 706 may flow linearly through the second oil supply passage 706 in the direction of central axis 804 (e.g., along a linear flow path 805 parallel to central axis 804 or coaxial with central axis 804). As a result, each deactivatable HLA is arranged along the linear flow path 803 of oil flowing through the first oil supply passage 704 and the linear flow path 805 of oil flowing through the second oil supply passage 706.

Each of the sockets 700 may house a respective deactivatable HLA (e.g., similar to the deactivatable HLAs 300 shown by FIG. 3 and described above), and each of the sockets 702 may house a respective non-deactivatable HLA (e.g., similar to the non-deactivatable HLAs 302 shown by FIG. 3 and described above). In the configuration shown by FIG. 8, the sockets 700 and sockets 702 are formed within the interior of cylinder head 400, with FIG. 8 showing a second cylinder bank 800 capped by the cylinder head 400. In one example, the second cylinder bank 800 may be similar to, or the same as, the first cylinder bank 210 shown by FIG. 2 and described above. In particular, the second cylinder bank 800 includes the sockets 700 of the deactivatable HLAs arranged at the inner cylinders of the second cylinder bank 800 (e.g., corresponding to the inner cylinders of the second cylinder bank 800 being deactivatable cylinders, similar to first inner cylinder 224 and second inner cylinder 226 described above), and the second cylinder bank 800 includes the sockets 702 of the non-deactivatable HLAs arranged at the outer locations of the second cylinder bank 800 (e.g., corresponding to the locations of the non-deactivatable outer cylinders of the second cylinder bank 800, similar to first outer cylinder 220 and second outer cylinder 222 described above).

Referring to FIG. 9, various HLAs are shown for comparison. In particular, FIG. 9 shows a deactivatable HLA 900 according to the present disclosure, a non-deactivatable HLA 902 according to the present disclosure, and a conventional non-deactivatable HLA 904. The deactivatable HLA 900 may be similar to, or the same as, the deactivatable HLAs described above, and the non-deactivatable HLA 902 may be similar to, or the same as, the non-deactivatable HLAs described above.

Deactivatable HLA 900 includes top end 906 and bottom end 912, and non-deactivatable HLA 902 includes top end 908 and bottom end 914. A length 918 of each of deactivatable HLA 900 and non-deactivatable HLA 902 is the same amount of length, as illustrated by the length 918 extending between axis 920 aligned with top end 906 of deactivatable HLA 900 and top end 908 of non-deactivatable HLA 902, and axis 916 aligned with bottom end 912 of deactivatable HLA 900 and bottom end 914 of non-deactivatable HLA 902. However, conventional non-deactivatable HLA 904 has a different length 922 relative to each of deactivatable HLA 900 and non-deactivatable HLA 902, as indicated by the length 922 extending between top end 910 of conventional non-deactivatable HLA 904 and axis 926 aligned with bottom end 924 of conventional non-deactivatable HLA 904.

By configuring the deactivatable HLA 900 and non-deactivatable HLA 902 to have the same length 918, the deactivatable HLA 900 and non-deactivatable HLA 902 may be seated within the corresponding sockets of the cylinder head (e.g., the sockets described above with reference to FIGS. 3-8) in order to align the deactivatable HLA 900 and non-deactivatable HLA 902 with the respective oil supply passages of the cylinder head (e.g., the oil supply passages described above). For example, as indicated by FIG. 9, a first oil inlet 930 (e.g., lash adjustment inlet) of the deactivatable HLA 900 may be arranged in alignment with an oil inlet 932 (e.g., lash adjustment inlet) of the non-deactivatable HLA 902 such that an axis 928 intersects each of the first oil inlet 930 and oil inlet 932. In one example, the axis 928 may be a central axis of an oil supply passage, such as oil supply passage 406 described above, and the oil supply passage may connect to the HLAs without bending or curving. A second oil supply passage of the cylinder head, such as the oil supply passage 404 described above, may be configured to intersect a second oil inlet 934 (e.g., deactivation inlet) of the deactivatable HLA 900 without bending or curving. In this configuration, HLAs may be fluidly coupled to the oil supply passages with greater ease (e.g., by reducing an amount of angled drilling, complicated casting, etc. of the oil supply passages associated with production of the cylinder head). In some examples, the first oil inlet 930 may be configured as the deactivation inlet and the second oil inlet 934 may be configured as the lash adjustment inlet.

Referring to FIG. 10, a method 1000 for controlling a flow of oil through a linear oil supply passage of a cylinder bank is shown. The linear oil supply passage described herein with reference to method 1000 may be similar to, or the same as, the linear oil supply passages described above (e.g., second oil supply passage 204 shown by FIG. 2, first oil supply passage 404 shown by FIG. 4, first oil supply passage 704 shown by FIGS. 7-8, etc.). The cylinder bank may be similar to, or the same as, the cylinder banks described above (e.g., first cylinder bank 210 or second cylinder bank 212 shown by FIG. 2, first cylinder bank 600 shown by FIG. 7, second cylinder bank 800 shown by FIG. 8, etc.).

At 1002 the method includes flowing oil through a linear oil supply passage arranged between opposing sides of a cylinder bank of an engine and parallel to a crankshaft of the engine. Flowing the oil through the linear oil supply passage includes flowing the oil along a linear path without bends or curves. In particular, the linear oil supply passage is without bends or curves within the cylinder bank, and as the oil flows through the oil supply passage, the oil is directed along the linear path by the linear oil supply passage. As one example, the oil may flow along a central axis of the linear oil supply passage (e.g., central axis 408 of second oil supply passage 406 described above with reference to FIG. 4, central axis 802 of first oil supply passage 704 described above with reference to FIG. 8, etc.). The oil flows along the linear path between first and second opposing sides of the cylinder bank (e.g., first side 236 and second side 238 of first cylinder bank 210 described above with reference to FIG. 2). The linear oil supply passage extends from the first side of the cylinder bank to the second side of the cylinder bank, and the oil flows along the linear path from the first side to the second side (or vice versa).

The method continues from 1002 to 1004 where the method includes supplying the oil directly from the linear oil supply passage to each of a deactivatable hydraulic lash adjuster and a non-deactivatable hydraulic lash adjuster. The deactivatable HLA and non-deactivatable HLA may be similar to, or the same as, the deactivatable HLAs and non-deactivatable HLAs, respectively, described above (e.g., deactivatable HLAs 244 and non-deactivatable HLAs 246 shown by FIG. 2, deactivatable HLAs 248 and non-deactivatable HLAs 250 shown by FIG. 2, deactivatable HLAs 300 and non-deactivatable HLAs 302 shown by FIG. 3, etc.). The oil may be supplied directly from the linear oil supply passage to respective inlets of the deactivatable HLA and a respective inlet of the non-deactivatable HLA. As one example, each HLA may be coupled to a corresponding rocker arm configured to drive a valve of the engine (e.g., intake valve or exhaust valve as described above), and a pressure of the oil may adjust operation of each HLA (e.g., adjust a position of a piston disposed within each HLA) to reduce a lash, or gap, between the corresponding rocker arm and a respective cam of a camshaft of the engine.

The linear oil supply passage supplies oil to the deactivatable HLA and non-deactivatable HLA and does not supply oil to any other oil consumers that are not HLAs along the linear oil supply passage. In particular, the linear oil supply passage is configured to supply oil directly to the deactivatable HLA and non-deactivatable HLA without any intervening oil passages, and although the linear oil supply passage may be configured to supply oil directly to additional deactivatable HLAs and/or non-deactivatable HLAs, the linear oil supply passage does not supply oil to other components of the engine. For example, the linear oil supply passage, deactivatable HLA, and non-deactivatable HLA may be similar to, or the same as, the second oil supply passage 204, deactivatable HLA 244 at first inner cylinder 224, and non-deactivatable HLA 246 at first outer cylinder 220, respectively, shown by FIG. 2 and described above. Although the second oil supply passage 204 is additionally configured to supply oil to the deactivatable HLA at second inner cylinder 226 and the non-deactivatable HLA at second outer cylinder 222, the second oil supply passage 204 does not supply oil to other oil consumers of the engine and is maintained separate from (e.g., spaced apart and not directly coupled to) the main oil gallery of the engine.

FIGS. 3-9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, by configuring the oil supply passages to extend linearly through the cylinder banks as described above, and by configuring the HLAs to have the same length to connect to the various oil supply passages without bending or angling the oil supply passages, an ease of production of the engine may be increased and a cost of production may be reduced.

The technical effect of configuring the HLAs to have the same length is to provide the HLAs with oil fed via the linear oil supply passages formed in the cylinder head of the engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an engine including a cylinder bank having a plurality of deactivatable inner cylinders and a plurality of outer cylinders;

a cylinder head capping the cylinder bank;

a first linear oil supply passage formed in the cylinder head and arranged parallel to a crankshaft of the engine;

a plurality of deactivatable hydraulic lash adjusters (HLAs) arranged along a linear flow path of the first linear oil supply passage and configured to receive engine oil directly from the first linear oil supply passage so as to control deactivation of the plurality of deactivatable inner cylinders; and a plurality of non-deactivatable HLAs arranged along the linear flow path.

2. The system of claim 1, wherein each deactivatable HLA receives the engine oil via a deactivation inlet.

3. The system of claim 2, further comprising a second linear oil supply passage fluidly coupled to each deactivatable HLA and each non-deactivatable HLA of the plurality of non-deactivatable HLAs.

4. The system of claim 3, wherein each deactivatable HLA and each non-deactivatable HLA includes a lash adjustment inlet fluidly coupled to the second linear oil supply passage.

5. The system of claim 3, wherein the second linear oil supply passage is arranged parallel to the first linear oil supply passage.

6. The system of claim 3, wherein a length of the first linear oil supply passage from a first side of the cylinder bank to a second side of the cylinder bank is equal to a length of the second linear oil supply passage from the first side to the second side.

7. The system of claim 3, wherein each deactivatable HLA is disposed within a respective socket of a first plurality of sockets formed within the cylinder head such that each socket of the first plurality of sockets is fluidly coupled to the first linear oil supply passage and the second linear oil supply passage.

8. The system of claim 7, wherein each non-deactivatable HLA is disposed within a respective socket of a second plurality of sockets formed within the cylinder head such that each socket of the second plurality of sockets is fluidly coupled to the first linear oil supply passage and the second linear oil supply passage, and wherein each socket of the first plurality of sockets has a same length as each socket of the second plurality of sockets.

9. The system of claim 1, wherein the first linear oil supply passage is formed without bends or curves.

10. The system of claim 1, wherein the first linear oil supply passage extends in a straight line between a first side of the cylinder bank and a second side of the cylinder bank, and wherein a first outer cylinder of the plurality of outer cylinders is arranged at the first side and a second outer cylinder of the plurality of outer cylinders is arranged at the second side.

11. The system of claim 1, wherein a length of each deactivatable HLA is equal to a length of each non-deactivatable HLA.

12. A system, comprising:

an engine including a plurality of cylinders capped by a cylinder head;

a first oil supply passage extending in a straight line through the cylinder head between a first side of the cylinder head and a second side of the cylinder head;

a second oil supply passage extends in a straight line through the cylinder head between the first side of the cylinder head and the second side of the cylinder head;

a plurality of deactivatable hydraulic lash adjusters seated within the cylinder head and in a flow path of the first oil supply passage and a flow path of the second oil supply passage; and a plurality of non-deactivatable hydraulic lash adjusters seated within the cylinder head and in the flow path of the first oil supply passage and the flow path of the second oil supply passage.

13. The system of claim 12, further comprising a plurality of intake passages and a plurality of exhaust passages formed in the cylinder head, wherein the oil supply passage extends without bends or curvature around the plurality of intake passages and the plurality of exhaust passages.

14. The system of claim 12, wherein each hydraulic lash adjuster is of equal length.

15. The system of claim 12, wherein the first oil supply passage is arranged parallel to the second oil supply passage such that the plurality of deactivatable hydraulic lash adjusters and the plurality of non-hydraulic lash adjusters are arranged along a central axis of the first oil supply passage and a central axis of the second oil supply passage.

16. A system, comprising:

an engine;

a first cylinder bank of the engine including a plurality of inner deactivatable cylinders arranged between a plurality of outer non-deactivatable cylinders disposed at opposing sides of the first cylinder bank;

a second cylinder bank of the engine including a plurality of inner non-deactivatable cylinders arranged between a plurality of outer deactivatable cylinders disposed at opposing sides of the second cylinder bank; and a first oil supply passage and a second oil supply passage each extending from the opposing sides of the first cylinder bank through the first cylinder bank without bending or curving, the first oil supply passage and second oil supply passage intersecting a first plurality of deactivatable hydraulic lash adjusters and a first plurality of non-deactivatable hydraulic lash adjusters.

17. The system of claim 16, further comprising:

a third oil supply passage extending partially through the second cylinder bank from a first side of the opposing sides of the second cylinder bank without bending or curving, the third oil supply passage terminating within an interior of the second cylinder bank;

a fourth oil supply passage extending from the opposing sides of the second cylinder bank through the second cylinder bank without bending or curving;

a second plurality of deactivatable hydraulic lash adjusters intersected and fed by the third oil supply passage and fourth oil supply passage; and a second plurality of non-deactivatable hydraulic lash adjusters intersected and fed by the fourth oil supply passage and not the third oil supply passage.

18. The system of claim 17, wherein each hydraulic lash adjuster is of an equal length.

* * * * *